United States Patent [19]

Hake

[11] 4,077,750

[45] Mar. 7, 1978

[54] ADJUSTABLE LIQUID DISPENSING PUMP

[76] Inventor: George H. Hake, 11154 Broadway, Alden, N.Y. 14004

[21] Appl. No.: 653,201

[22] Filed: Jan. 28, 1976

[51] Int. Cl.[2] ..... F04B 21/04; G01F 11/02

[52] U.S. Cl. ..... 417/552; 92/13.8; 222/309; 222/385

[58] Field of Search ..... 92/13.5, 13.8, 13.7, 92/13.4; 222/383, 309; 403/112, 107; 417/549, 545, 550, 552, 553, 63

[56] References Cited

U.S. PATENT DOCUMENTS

| | | | |
|---|---|---|---|
| 461,049 | 10/1891 | Roberts | 403/107 |
| 1,615,380 | 1/1927 | Hill | 417/549 |
| 2,136,836 | 11/1938 | Bernard | 403/107 |
| 2,198,666 | 9/1936 | Gruskin | 222/309 |
| 2,445,279 | 7/1948 | Palm et al. | 92/13.4 |
| 2,858,767 | 10/1955 | Smith | 417/553 |
| 3,211,335 | 10/1965 | Shapiro | 222/383 |

FOREIGN PATENT DOCUMENTS

| | | | |
|---|---|---|---|
| 192,562 | 10/1957 | Austria | 222/383 |

*Primary Examiner*—William L. Freeh
*Attorney, Agent, or Firm*—Ashlan F. Harlan, Jr.

[57] ABSTRACT

A liquid dispensing pump particularly designed for dispensing measured amounts of edible liquids such as molten chocolate into molds, that may be of varying capacities. The pump dispenses, from a filled pump barrel, on outward movement of a valved piston and the quantity dispensed is determined by the position of a stop pin in a notched tube that is moved in unison with the piston rod and pivoted stop plates that limit movement of the stop pin. The pump is readily disassembled for cleaning and is adapted for easy mounting on a tank.

9 Claims, 4 Drawing Figures

1/4 oz
1/4 oz
1/4 oz

ADJUSTABLE LIQUID DISPENSING PUMP

BACKGROUND OF THE INVENTION

The invention of the present application relates to adjustable dispensing pumps for liquids and is particularly concerned with such pumps which are manually operated and are adapted for dispensing accurate, but variable, amounts of liquids and which can be easily adjusted and kept in sanitary condition for use with edible liquid products such a molten chocolate.

In the molding or casting of hollow chocolate forms such as are widely used, particularly around Easter and Christmas, for figures of rabbits, eggs, chickens and Santas, it is desired to supply carefully measured amounts of molten chocolate to the molds, the amount used for any specific mold depending upon the size of the mold and the desired wall thickness of the form or figure to be molded. Although measuring vessels can be used, when a number of molds of different sizes are to be filled successively, such use results in slower production because it requires measuring vessels of different sizes or the careful partial filling of a vessel to a specific mark. Thus, a dispensing pump is desirable which is adapted to deliver a measured amount with each stroke and which is quickly and easily adjustable for delivery of different amounts. Such a dispensing pump must, however, be easily disassembled for cleaning when edible liquid products such as molten chocolate are employed therein.

Although dispensing pumps that can be so used are known the novel pump of the present invention is an improvement thereon because of its simple construction, easy adjustment, and convenience of operation.

SUMMARY OF THE INVENTION

A liquid dispensing pump according to the invention is of simple construction and readily assembled and disassembled for cleaning and sterilization. There is an elongated barrel providing a pump chamber. The barrel is provided at one end with a base in which there is mounted an inwardly-opening check valve and the reciprocating piston of the pump is also provided with a check valve, opening in the same direction, whereby liquid in the pump barrel is dispensed through a spout and nozzle connected to the other end of the barrel simultaneously with the filling of the barrel behind the piston. Means comprising a tube operatively connected to the piston and moveable therewith and a stop pin engageable in equi-spaced notches in said tube and adapted to contact said spout is provided for selectively determining the extent of outward travel of the piston and hence the volume, i.e. the number of units, of liquid dispensed by a single pump stroke. Pivoted stop plates that can be interposed between the stop pin and the spout provide means for limiting the piston movement to permit dispensing fractional units of liquid. Novel means is also provided for attachment of the dispensing pump to a container from which the liquid is to be drawn.

SHORT DESCRIPTION OF THE DRAWINGS

DESCRIPTION OF A PREFERRED EMBODIMENT

Figures 1, 2, 3:
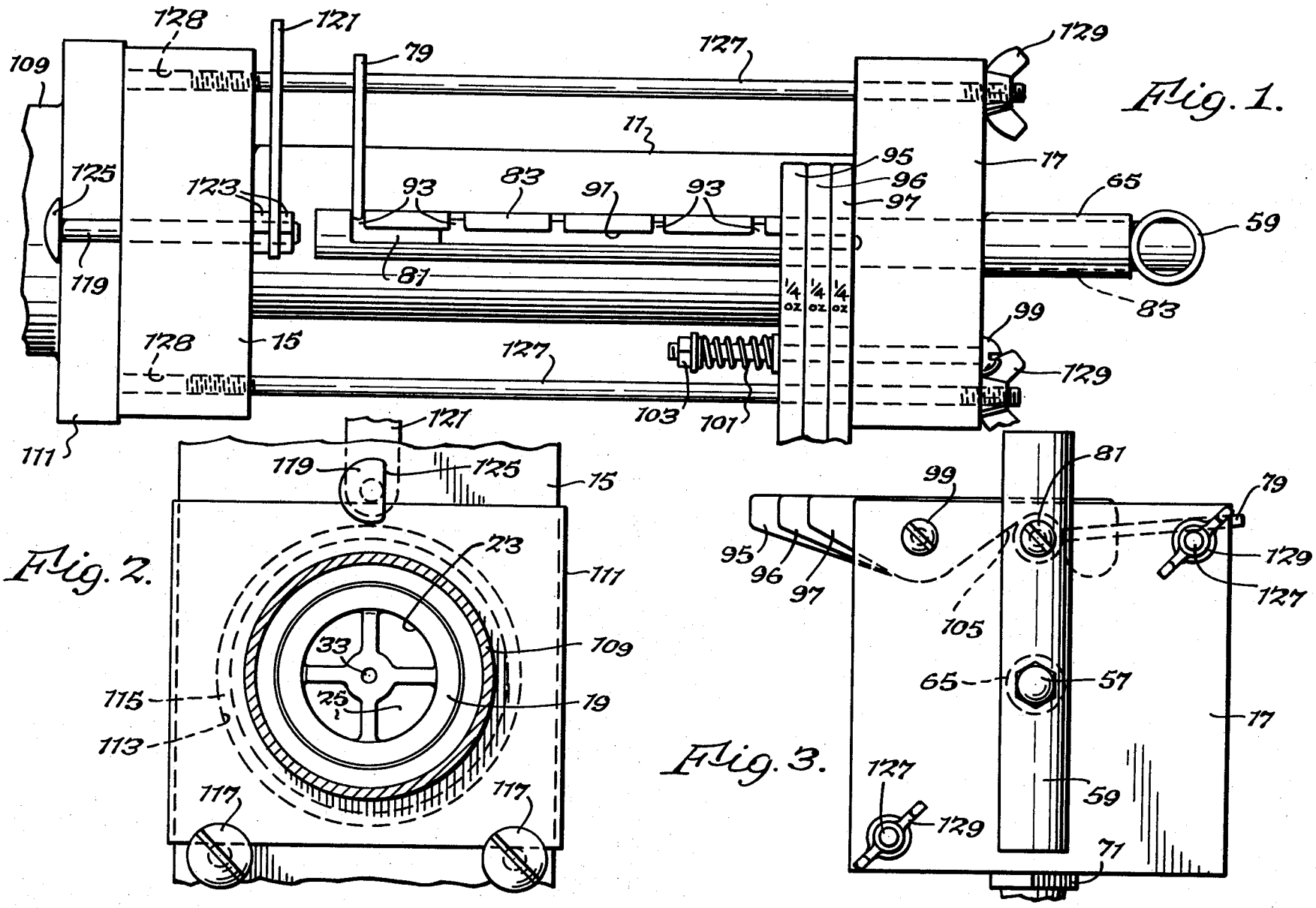
FIG. 1 is a top plan view of a dispensing pump according to the present invention.
FIG. 2 is a rear view, taken on line 2—2 of FIG. 4, showing details of the means for securing the pump illustrated in FIG. 1 on a barrel or other container.
FIG. 3 is a front elevation of the pump illustrated in FIG. 1.

The terms "upper", "lower", "top", "bottom", "right", "left", "above", "below", "vertical", and "horizontal", and similar terms of position and/or direction as used hereinafter refer to the illustrations in FIGS. 1 and 4, but are used only for convenience in description and/or reference. Such terms should not be so construed as to imply a necessary positioning of the structure or portions thereof or to limit the scope of this invention.

The dispensing pump of the present invention comprises an elongated, tubular, dispensing barrel or reservoir 11 forming a pump chamber 12. The barrel is threadedly engaged, at one end, in a bore or passage 13 in a base 15 and is threadedly engaged at the other end in a spout or outlet member 17. The body 19 of a check valve 21 is threadedly engaged in the end of the bore 13 opposite the barrel 11. Annularly arranged, equidistant, longitudinal ports 23 are provided in the body 19 and an annular valve disc 25 is seated on the body to cover said ports. A coiled compression spring 27 bears resiliently against the outer side of the valve disc 25 to hold the disc seated and the ports 23 closed. The spring 27 is held in position by an annular retainer 29, that rests on the outer end of a central, outwardly projecting, tubular guide 31 for the valve disc 25, and is secured thereon by a screw 33 threadedly engaged in the outer end of said guide.

Suitably mounted for reciprocation in the barrel 11 is a valved piston 35, preferably axially aligned with the check valve 21, which comprises a hollow cylindrical head 37 having an annular chamber 39 surrounding a central boss 41. The chamber 39 is open on the rear side of the piston, i.e. the side facing the check valve 21, and is provided on the opposite, or front, side with a plurality of longitudinal ports 43, preferably symmetrically arranged. A valve disc 45 is adapted to close the ports 43 by seating on the outer face of the piston 35. The disc 45 is guided by a central, outwardly projecting extension 49 of the central boss 41 and is resilently held in position closing the ports 43 by a coiled compression spring 51. The boss 41 and the extension 49 thereof, which preferably is integral with the boss, are provided with a longitudinally extending axial bore 53 in which one end of an elongated piston rod 55 is threadedly engaged. The rod 55 extends through the chamber 12 and the spout member 17 and the outer end of the rod, projecting forwardly through the outer wall of the member 17, is attached by suitable means, such as a cap nut 57, to a tubular handle 59. Outwardly of the extension 49 of the boss 41 the piston rod 55 is enclosed or covered by a coaxially disposed tube 61 which, at its outer end bears against the handle 59 and at its inner end bears against an annular retainer 63 for the spring 51, which retainer is seated on the outer end of the extension 49.

The end of the barrel 11 opposite the bore 13 is threadedly engaged in a bore 67 in the spout member 17 and the chamber 12 in the barrel communicates with a discharge chamber 69 in the spout. A tubular discharge nozzle 71 is threadedly engaged in another bore 73 in the spout 17. The bore 73 is preferably tapered and communicates with the chamber 69 at the bottom of the latter. The nozzle 71 provides an outlet for liquid from the chamber 69. A bore 75 concentric with the barrel 11 extends through the outer wall of the spout member 17 for passage of the tube 61 and the piston rod 55; and, preferably, means such as an O-ring 77 is provided in the periphery of the bore 75 to seal around the tube 61.

It will be apparent that the novel pump, as described, will transfer liquid from a source of supply connected to the base 15 through the barrel 11, the spout 17, and the nozzle 71 to a suitable receptacle (not shown) placed under the nozzle. With the barrel 11 empty and the piston 35 at the limit of its travel to the left, as viewed in FIG. 4, outward movement of the piston will result in flow into the barrel through the valve ports 23 so that the barrel is substantially filled with the liquid which does not, however, pass through the ports 43 in the valved piston. But flow through the valve ports 43 does result when the piston is then moved to the left since the liquid in the barrel 11 can not return through the check valve 21. When the piston is again moved to the right the valve disc 45 on the piston is closed and liquid in the barrel ahead of the piston is forced out of the spout member 17 through the nozzle 71. Simultaneously, liquid is drawn into the barrel behind the piston and this liquid is transferred through the valve in the piston 35 when the piston is next moved inwardly.

Figure 4:
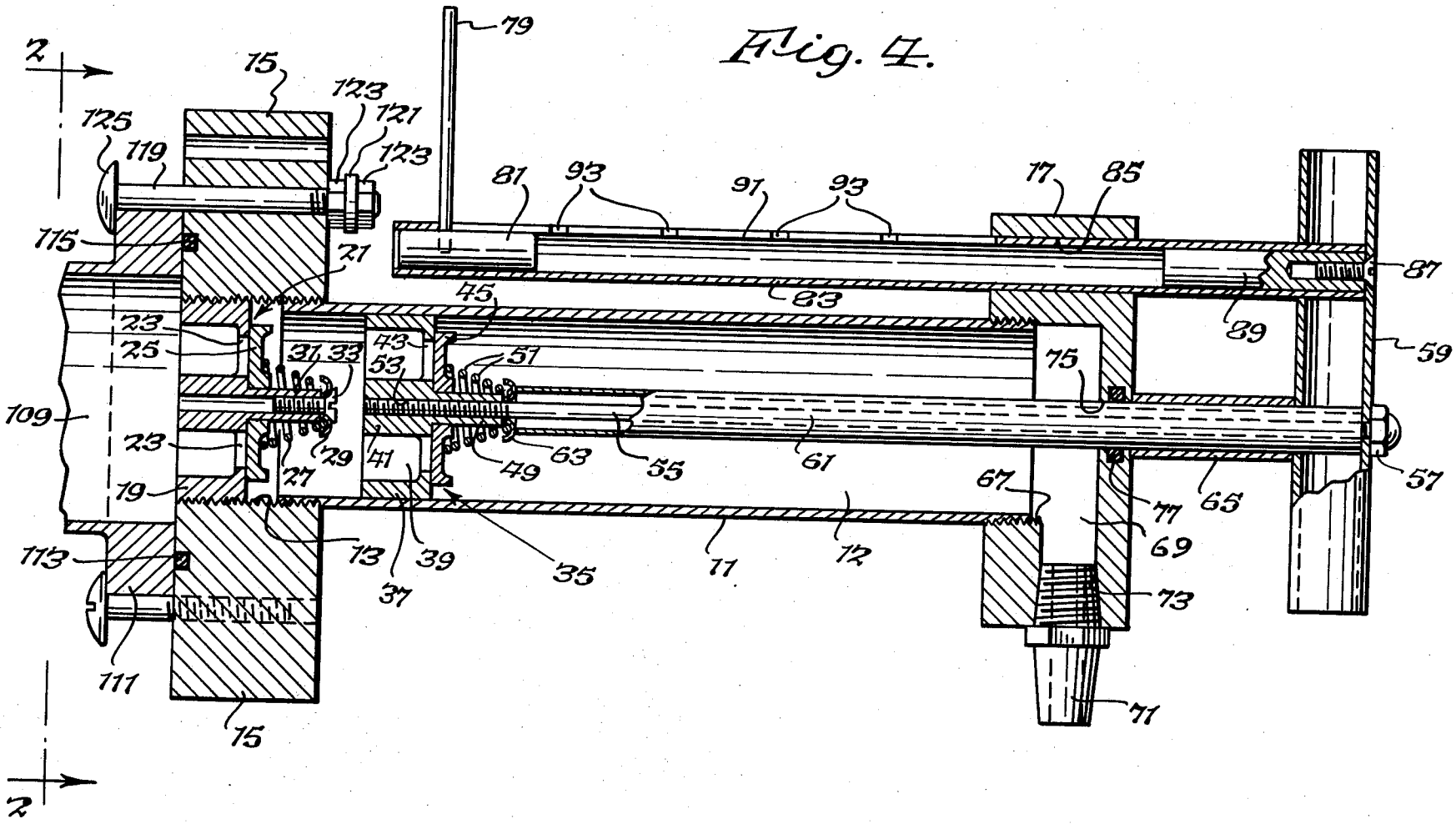
FIG. 4 is a longitudinal, vertical, sectional view of the pump illustrated in FIG. 1 with a portion of the container to which it is attached.

To provide for dispensing various predetermined amounts of liquid the novel pump of the present invention is provided with stop means by which is determined the distance the piston can travel to the right, as viewed in FIG. 4, and thus the amount of liquid dispensed on each outward stroke of the pump is determined. The primary regulation of the outward piston travel is provided by a stop arm or pin 79 removably carried by a plug 81 that is longitudinally and rotatably moveable in an elongated tube 83. The latter is slidably carried by the spout member 17 in a bore 85 that is parallel to the piston rod 55 and the tube 61. The tube 83 is suitably attached, as by a screw 87 engaged in a plug 89 that is firmly secured by suitable means (not shown) in the end of the tube, to the handle 59, whereby the tubes 61 and 83 and the piston rod 55 are moved simultaneously by the handle. Adjacent its left end, the tube 83 is provided with a longitudinal slot 91 having, in one edge thereof, a plurality of longitudinally spaced notches 93 in which the stop arm 79, which extends laterally from the slide 81, may be selectively engaged. Accordingly, when the handle 59 is pulled to move the piston 35 outwardly the stop arm or pin 79, resting in one of the notches 93, engages the spout member 17 and/or other means hereinafter described, and thus determines the length of the piston stroke.

The notches 93 are preferably spaced equidistantly and when the piston 35 is at its limit of inward movement, i.e. when sleeve 56, preferably formed of metal or rigid plastic material and slidably mounted on the tube 61, is engaged at its respective ends by the handle 59 and the body of the spout member 17, the notch nearest the spout member 17 is spaced therefrom the same distance. The notches 93 may be spaced any desired distance, but it is convenient for them to be so spaced that outward movement of the piston for the distance between adjacent notches will dispense a single, specified unit of liquid, e.g. one ounce.

As shown in FIGS. 1 and 3, means is also provided for dispensing fractional units of liquid. Such means comprises a plurality of stop plates 95, 96, and 97 pivotally mounted on a rod-like member, such as bolt 99, that extends through an upper corner of the spout member 17 parallel to the barrel 11 and the tube 83. Preferably, however, the bolt 99 does not extend through the chamber 69 in the spout member. The plates 95, 96, and 97 are preferably of the same thickness, e.g. one-quarter of the distance between adjacent notches 93 in the tube 83, and are mounted on the bolt 99 parallel to and in contact with each other and with the plate 97 parallel to and in contact with the back surface of the spout member 17. Such contact of the stop plates with each other and with the spout member is assured by a coiled compression spring 101 held on the bolt 99 by the nut 103 and bearing against the end stop plate 95. The plates 95–97 may be of any desired shape, but should be so dimensioned that they can be pivotally moved from a first position in which the inner ends thereof engage and rest on the tube 83 to another position in which they are not so engaged. Preferably, the ends of the plates that engage the tube 83 are provided with grooves or cut away portions 105 that may ride on the tube when the latter is reciprocated. The other ends of the stop plates, when the plates are in position to engage the tube 83, preferably extend varying distances beyond the side of the spout member 17 that is adjacent the bolt 99 to permit easy selection and grasping.

It will be evident that the stop plates 95–97, in conjunction with the notched, slotted tube 83 and the stop pin 79, provide for easy and convenient adjustment of the volume of liquid dispensed from the barrel 11 when the piston 35 is moved outwardly in the barrel after filling the latter by an inward piston stroke. The notch 93 in which the pin 79 is set determines the maximum amount that can be dispensed by each stroke and this amount may be fractionally reduced by pivotally positioning one or more of the stop plates 95–97 where it will be contacted by the pin.

It will be understood that the novel dispensing pump of the present invention can be supplied with liquid in any desired way. However, there is illustrated and hereinafter described a novel and convenient way of securing the pump to a tank having a flanged outlet. The construction is best seen in FIGS. 2 and 4 where the tubular outlet 109 of a tank (not shown) is provided with a flange 111 against which the outer face of the base 15 engages. Leakage between the flange and base is prevented by an O-ring 113 provided in an annular groove 115 in said outer face. The pump base 15 is secured to the flange 111 by two pan head screws or carriage bolts 117 threadedly mounted, respectively, in the base 15 adjacent its lower corners and, adjacent the top of the base, a longer carriage bolt 119 that extends completely through the base and is provided on its threaded end with a turning handle 121 locked on the bolt by a pair of nuts 123. All of the bolts 117 and 119 are substantially parallel to the barrel 11 and have their heads on the back of the base 15. Preferably the bolt 119 is arranged equidistantly from the bolts 117. Obviously other means can be provided for connecting the pump to a tank or other source of liquid supply.

The head of the bolt 119 is cut or ground off on one edge to provide a flat portion 125, as shown in FIG. 2. In attaching the dispensing pump to the tank, each of the bolts 117 and 119 is adjusted to make the distance from the underside of the bolt head to the base equal to the thickness of the flange 111. Then the bottom edge of the flange 111 is inserted between the heads of the bolts 117 and the base 15, and the bolt 119 is turned by the handle 121 to position the flat portion 125 on the head thereof so that the head can pass over the upper edge of said flange. After the flange 111 and upper portion of the base 15 are brought together, compressing the O-ring 113, the handle 121 can be turned to engage the head of the bolt 119 over the flange 111 and thereby hold the base and flange together.

The base 15 and spout member 17 are held in rigid alignment by elongated studs 127. The studs are mounted, preferably threadedly, in bores 128 in the base that are located adjacent diagonally opposite corners thereof; and they extend through aligned bores in the spout portion 17. Wing nuts 129 are provided on the outer ends of the studs 127 to permit applying longitudinal clamping pressure on the barrel.

It will be observed that the novel dispensing pump of the present invention is easily assembled and disassembled. This is important, particularly when such a pump is employed in dispensing edible products, e.g. molten chocolate, since it will in such case be necessary to take the device apart at frequent intervals for cleaning and sterilization. Such necessity also calls for the use of materials that can be sterilized and will not be attacked or corroded by the liquid being dispensed and/or the cleaning media used. Thus metals such as stainless steel, heat-resistant plastic materials such as nylon, and ceramic materials are preferred for the construction of the portions of the novel pump that come into contact with the liquid being dispensed.

In the foregoing description the mechanism for determining the amount of liquid dispensed as a piston stroke is set forth. The operation of the illustrated device in more detail, is as follow: The spacing between the notches 93 in the tube 83 is determined by calculation based on the specific gravity of the dispensed liquid, the cross sectional diameter of the chamber 12, and the desired unit of measurement. For illustration, the notch spacing and the position of the stop pin 79 as shown in FIG. 1 is assumed to be such that the pump would dispense five ounces when the piston 35 is moved outwardly until the stop pin 79 contacts the rear face of the spout member 17, i.e. with the stop plates 95–97 pivoted upwardly to disengage them. With the stop pin engaged in the next notch to the right, four ounces would be dispensed, and so on. When fractions of a unit are desired, one or more of the stop plates 95, 96, and 97 is employed. Thus, with all three stop plates in contact with the tube 83, as shown in FIG. 1, outward movement of the piston would be arrested after only four and a quarter ounces were dispensed. If the stop plate 95 were to be pivoted upwardly, out of the path of the pin 79, four and one half ounces of liquid would be dispensed. When employing only the plate 97, four and three-quarters ounces would be dispensed.

Obviously, by varying the thickness and number of the stop plates provided, the size of the fractional units dispensed with a piston stroke can be changed as desired. It will be apparent that the mechanism for varying the quantity of liquid dispensed by a piston stroke makes many liquid dispensing operations much more convenient. For example, when filling a succession of molds of the same size, the amount of fluid needed for each mold can be quickly and accurately dispensed with a single stroke of the piston. Further adjustment is only required when a mold of different size is encountered. Such adjustment can, however, be made so rapidly, as described above, that a succession of molds of different capacities presents no problem.

It will be understood that dispensing pumps according to the invention can be of different sizes and that other modifications of the illustrative example can be made without departing from the spirit of the invention.

I claim:

1. An adjustable dispensing pump for liquids comprising: a base having a passage therethrough for connection to a source of liquid, an inwardly opening check valve mounted in said passage; a separate elongated barrel, having one end thereof removably mounted in said base, forming a pump chamber communicating through said check valve with said source of liquid; a spout member removably carried by the other end of said barrel, said spout member having a discharge chamber communicating with said pump chamber and a discharge nozzle communicating with said discharge chamber; a piston slidably reciprocatable in said barrel; a check valve carried by said piston permitting flow therethrough only from the rear of said piston to the front thereof; a piston rod operatively attached to said piston on the front thereof and extending through said spout member; an operating handle connected to said piston rod; and means, slidably carried by and having a portion cooperating with said spout member to arrest outward movement of said piston, said means comprising a tube removably attached to and movable by said handle with said piston rod for selectively determining the volume of liquid dispensed by an outward stroke of said piston, said tube being provided with slidable and rotatable means therein for restricting the length of the piston stroke.

2. A dispensing pump as defined in claim 1 wherein said base is provided with means for clamping it to a flanged outlet from a container.

3. A dispensing pump as defined in claim 2 wherein said clamping means comprises a plurality of bolts mounted in said base engageable with the edges of a flanged outlet from a container.

4. A dispensing pump as defined in claim 3 wherein the heads of said bolts extend outwardly from said base parallel with said barrel and engage over said edges and wherein the head of one of said bolts is reduced in area and is shaped whereby to engage an edge of said base in certain angular positions.

5. A dispensing pump as defined in claim 1 wherein said tube is provided with a longitudinal slot having spaced notches is one edge thereof and said slidable and rotatable means includes a plug movable in said tube and carrying a stop pin selectively engageable in one of said notches and adapted to contact said spout member to arrest movement of said piston.

6. A dispensing pump as defined in claim 5 wherein additional, pivoted means carried by said spout member is provided for selective cooperation with said stop pin.

7. A dispensing pump as defined in claim 6 wherein said pivoted means comprises a stop plate that can be interposed between said stop pin and said spout member.

8. A dispensing pump as defined in claim 6 wherein said pivoted means comprises a plurality of stop plates that can be selectively interposed between said stop pin and said spout member.

9. A dispensing pump as defined in claim 8 wherein said stop plates are pivotally mounted on a rod-like member carried by said spout member, wherein said check valves are provided with annular reciprocatable, valve discs and springs biasing said valve discs to sealing positions, and wherein said check valves are axially aligned.

* * * * *

UNITED STATES PATENT AND TRADEMARK OFFICE

CERTIFICATE OF CORRECTION

PATENT NO. : 4,077,750

DATED : March 7, 1978

INVENTOR(S) : George H. Hake

It is certified that error appears in the above-identified patent and that said Letters Patent are hereby corrected as shown below:

Column 2, line 36, "Suitably" has been changed to -- Slidably --.

Column 3, line 57, "56" has been changed to -- 65 --.

Signed and Sealed this

*Eighth* Day of *August 1978*

[SEAL]

*Attest:*

RUTH C. MASON
*Attesting Officer*

DONALD W. BANNER
*Commissioner of Patents and Trademarks*